US007496302B2

(12) United States Patent
Lane et al.

(10) Patent No.: US 7,496,302 B2
(45) Date of Patent: Feb. 24, 2009

(54) BLACK PRINT QUALITY ENHANCEMENT FOR HIGH HUMIDITY ENVIRONMENT

(75) Inventors: David Keith Lane, Lexington, KY (US); Julie Ann Gordon Whitney, Georgetown, KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 11/610,239

(22) Filed: Dec. 13, 2006

(65) Prior Publication Data

US 2008/0145073 A1 Jun. 19, 2008

(51) Int. Cl.
*G03G 15/00* (2006.01)

(52) U.S. Cl. ..... 399/44; 399/97; 399/299; 399/302; 399/308; 399/313; 347/112

(58) Field of Classification Search ..... 399/44, 399/97, 299, 302, 308, 313; 347/11
See application file for complete search history.

(56) References Cited

U.S. PATENT DOCUMENTS

| | | | | |
|---|---|---|---|---|
| 5,128,718 | A * | 7/1992 | Mizoguchi | 399/44 |
| 6,031,629 | A * | 2/2000 | Shibuya et al. | 358/1.9 |
| 6,118,557 | A * | 9/2000 | Sugiyama et al. | 358/504 |
| 7,116,821 | B2 | 10/2006 | Lane et al. | |
| 2001/0028803 | A1 * | 10/2001 | Yoda | 399/44 |
| 2002/0093687 | A1 * | 7/2002 | Kerby | 358/3.14 |

* cited by examiner

*Primary Examiner*—David M Gray
*Assistant Examiner*—G. M. Hyder

(57) ABSTRACT

An improved color EP (laser) printer is provided for use in high humidity conditions. A humidity sensing circuit determines if the print quality might be degraded due to environmental conditions, using a resistivity sensing circuit, or a humidity sensor. If the print quality would likely be degraded, the invention is able to enhance toner transfer by printing supplemental process black toner dots underlaying standard black toner dots at predetermined pixel locations in the bitmap of a print job. This assumes that the black printing station is the "last" station along the travel of the intermediate transfer member. Other colors could be used for the supplemental toner dots.

24 Claims, 4 Drawing Sheets

BLACK PRINT QUALITY ENHANCEMENT FOR HIGH HUMIDITY ENVIRONMENT

TECHNICAL FIELD

The present invention relates generally to image forming equipment and is particularly directed to an electrophotographic printer of the type which prints using multi-color toner. The invention is specifically disclosed as a color laser printer that determines when high humidity conditions exist, and then compensates for such conditions by printing process black toner dots "underlaying" standard black toner dots at predetermined pixel locations in the bitmap of a print job.

BACKGROUND OF THE INVENTION

Temperature extremes and especially changes in humidity effect the resistively of transfer components in an electrophotographic (EP) printing system. With increasing humidity, resistivities of transfer rolls, intermediate belts, and paper all decrease. When the resistively decreases, it is more difficult to build a transfer field to move toner from an intermediate belt to the print media (e.g., paper).

Toner that is printed onto an intermediate belt or drum will gain charge when passing under additional color nips, such as found in a color laser (or EP) printer that has multiple color printing stations, in which each printing station has a transfer nip comprised of a photoconductive drum and a transfer roller. The gain in charge by passing under additional color nips can frequently improve the print quality of the toner by improving the "force" on the toner, thereby encouraging it to transfer. (In the case, the word "force" is equivalent to voltage or "EMF" {electromotive force}.) However, the last nip in the process sequence, typically the black tone station, does not benefit from charge boost from additional nips. To compensate for this, some printer designers have added coronas or other charge members to increase the toner charge before transfer. These additional members can have environmental or cleaning issues, and also have associated additional costs. It may be difficult to justify adding such additional members when the problem manifests itself only during high humidity conditions.

SUMMARY OF THE INVENTION

Accordingly, it is an advantage of the present invention to provide an EP printer that improves the transfer capabilities for the final printing station, typically the black toner, without having to add further components to the printer, or to use corona defects, or the like.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an image forming apparatus is provided, which comprises: a humidity sensing device; a print engine that includes a movable intermediate transfer member and a plurality of image-forming stations that apply image-forming material to the intermediate transfer member during a print job that generates a bitmap which comprises a plurality of pixel locations; a print media handling device that moves print media to a transfer nip, where the image-forming material is transferred from the intermediate transfer member to the print media; wherein: (a) one of the image-forming stations applies black image-forming material; (b) at least three of the other image-forming stations apply other colors that are equivalent to a process black; (c) the black image-forming station is the last of the plurality of image-forming stations to apply image-forming material to the intermediate transfer member as it travels past the image-forming stations; and (d) if the humidity sensing device determines that a high humidity condition exists such that compensation is desired, then; (i) a first set of the pixel locations is determined where black image-forming material is placed upon the intermediate transfer member by the black image-forming station; and (ii) a second set of the pixel locations is determined that is at least a subset of the first set of the pixel locations, and, at the second set of the pixel locations process black image-forming material is placed upon the intermediate transfer member by the at least here of the other image-forming stations.

In accordance with another aspect of the present intention, a method for compensating for environmental conditions, when using an image forming apparatus is provided, in which the method comprises the following steps: (a) providing an image forming apparatus having: (i) a print engine that applies image-forming material to a movable intermediate transfer member at a plurality of image-forming stations, (ii) a print media handling device that moves print media to a transfer nip, where the image-forming material is transferred from the intermediate transfer member to the print media, and (ii) a humidity sensing device; (b) processing a print job that generates a bitmap which comprises a plurality of pixel locations; and (c) determining whether a high humidity condition exists such that compensation is desired, and if so, then; (i) determining a first set of the pixel locations, and thereat placing black image-forming material upon the intermediate transfer member using a black image-forming station of the plurality of image-forming stations; and (ii) determining a second set of the pixel locations that is at least a subset of the first set of the pixel locations, and, at the second set of the pixel locations, placing supplemental image-forming material upon the intermediate transfer member using at least three of the other image-forming stations.

In accordance with yet another aspect of the present invention, an image forming apparatus is provided, which comprises: a humidity sensing device; a print engine that includes a movable intermediate transfer member and a plurality of image-forming stations that apply image-forming material to the intermediate transfer member during a print job that generates a bitmap which comprises a plurality of pixel locations; a print media handling device that moves print media to a transfer nip, where the image-forming material is transferred from the intermediate transfer member to the print media; wherein: (a) a first of the image-forming stations applies first image-forming material of a first color, and a second of the image-forming stations applies second image-forming material or a second color; (b) the first image-forming station applies a color that is more visually dark than the color that is applied by the second image-forming station; (c) the first-image forming station is the last of the plurality of image-forming stations to apply image-forming material to the intermediate transfer member as it travels past the image-forming stations; and (d) if the humidity sensing device determines that a high humidity condition exists such that compensation is desired, then: (i) a first set of the pixel locations is determined where first image-forming material is placed upon the intermediate transfer member by the first image-forming station; and (ii) a second set of the pixel locations is determined that is at least a subset of the first set of the pixel locations, and, at the second set of the pixel locations, second image-forming material is placed upon the intermediate transfer member by the second image-forming station.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
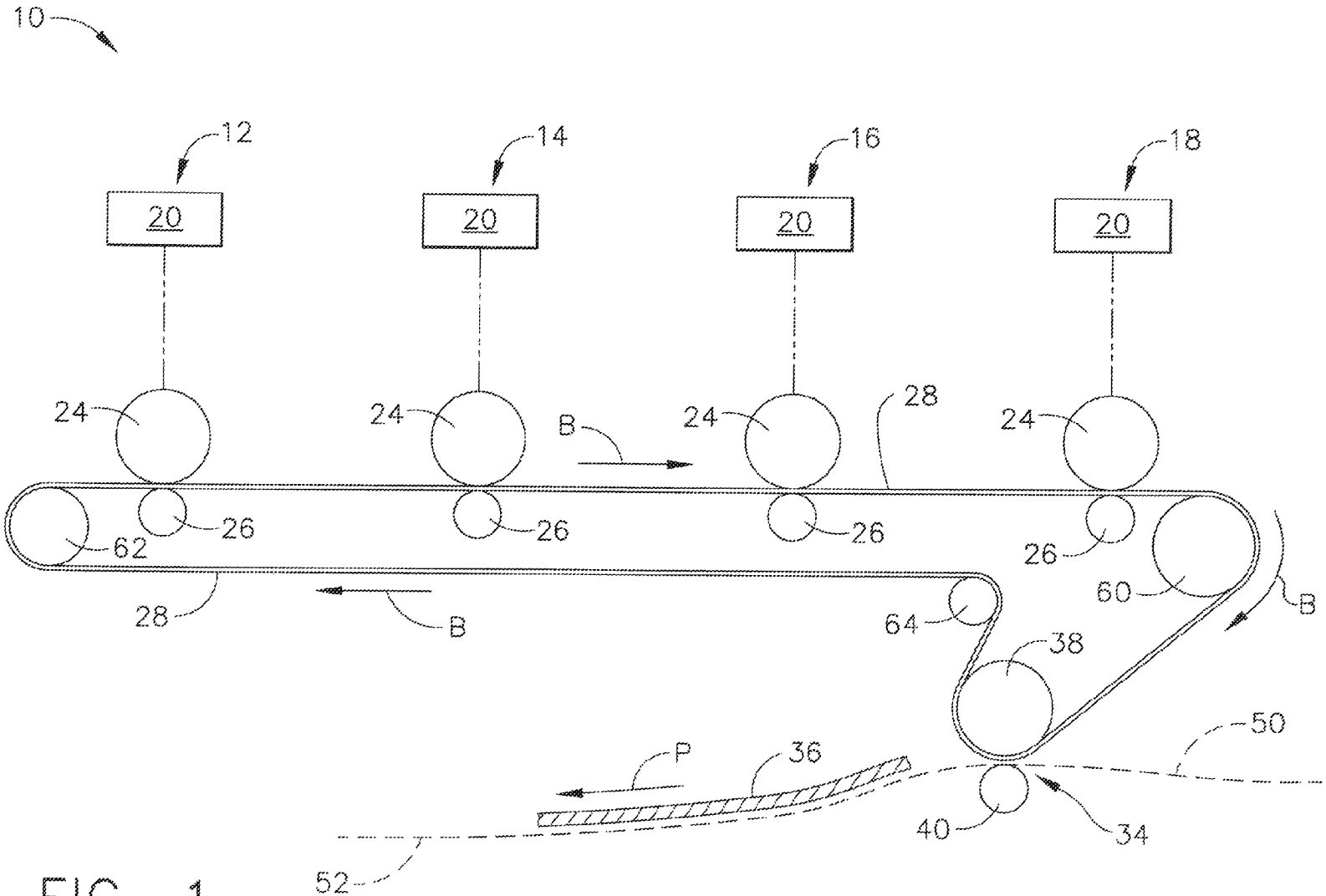
FIG. 1 is a diagrammatic view of some of the major components of a color EP printer, as constructed according to the principles of the present invention.

Referring to FIG. 1, a color electrophotographic (EP) printer typically includes four color stations 12, 14, 16, 18 for the four colors, yellow (Y), cyan (C), magenta (M), and black (K), that are typically used in color printing. Each color station includes a laser printhead 20 and associated toner supply. Each color station also includes a rotatable photoconductive (PC) drum 24 having a chargeable and dischargeable photoconductive surface layer. An image is developed on each PC drum in a manner known in the art. An electrically biased transfer roller 26 is provided in association with each PC drum. An intermediate transfer member (ITM) (or belt) 28 travels in an endless loop through the nips between each PC drum 24 and its transfer roller 26, and the images developed on the PC drums are transferred to the ITM belt 28 by an electrically-biased roll transfer operation. The four PC drums 24 and transfer rollers 26 constitute major components of a first transfer assembly 10.

A second transfer area (or nip) 34 is provided, at which the image on the ITM belt 28 is transferred to a media substrate 36, often referred to as "print media." The second transfer area includes a backup roller 38, on the inside of the ITM belt, and a transfer roller 40 on the opposite side of the belt 28. Substrate media, or "print media," such as paper, cardstock, labels, or transparencies, are fed from a media supply (not shown) that travels along a pathway 50, and the print media is introduced at the nip 34 in registration with the image on the ITM belt, then driven through the nip 34 between the backup roller 38 and transfer roller 40. The (toner) image is transferred from the ITM belt 28 to the print media 36, as the print media moves in the direction of arrow "P" on FIG. 1. Thereafter, the print media moves along a pathway 52, and in many EP printers, then passes over a guide plate and media transport belt (not shown), to a fuser assembly (not shown), where the toner is fused to the print media. The print media is then transferred out of the printer or, in duplex printing operations, returned back to the second transfer area 34 for transfer of a subsequent image onto the other side of the print media.

The ITM belt 28 is supported by rollers for travel in an endless loop. In color printing operations, the belt 28 travels first past the yellow, then the cyan, then the magenta, and last the black toner stations, in a standard design manufactured by Lexmark International, Inc. A drive roller 60 is provided at one end of the first transfer assembly 10, and a tracking and tension roller 62 is provided at the other end. It will be appreciated that the locations of these rollers could be switched, and that the positions of the color toner stations could be altered. However, as will be explained below, it is preferred that the black toner stations be the "last" one along the direction of travel "B" of the ITM belt 28, i.e., for the color station 18 to be the black toner station. The ITM belt 28 typically is formed of a resistive material having a substantially uniform thickness and a high tensile modulus.

The ITM belt 28 is also supported by the backup roller 38, and preferably by a reverse roller 64. The reverse roller 64 is located on the outer surface of the belt 28 and reverses the curvature of the belt, which moves the belt away from the media substrate path existing from the second transfer assembly. This shift of the belt path allows operator access to the area below the belt to clear paper jams if necessary. The reverse roller 64 is also electrically grounded and has good toner release characteristics. Electrically, this conductive roller 64 assists in resetting the belt to a neutral electrical condition prior to the next revolution through the process.

In operation, to transfer toner from the PC drum 24 to the ITM belt 28 at the first transfer assembly 10, the rotating PC drum surface is charged by a charging assembly (not shown). Portions of the drum surface are selectively discharged by the optical energy from a laser, LED array, or the like in the printhead 20 for each color station. Toner is transferred to the PC drum 24 as determined by the pattern of charge on the drum and developed by a developing assembly (not shown). The developed toner is then transferred to the ITM belt 28 at the nip between the PC drum 24 and the transfer roller 26. To effect the movement of the toner to the ITM belt, a high voltage power supply (not shown) is electrically connected to the shaft of each transfer roller 26 to apply a voltage to the transfer roller opposite in polarity to the charge on the toner. All operations are controlled by any suitable controller.

In one mode of the invention, each PC drum 24 is typically formed with a metal core, such as aluminum, maintained at a preselected voltage. The core is coated with a multi-layer organic photoconductive material. In many EP printers, the transfer roller 26 typically is formed from a urethane foam with a conductive agent therein, such as an ionic salt. A high voltage power supply (not shown) is electrically connected to each transfer roller shaft.

A transfer servo operation is performed prior to printing to establish an initial or "servo" voltage. The voltage on the PC drum 24 entering the transfer nip is maintained at a controlled potential. Vpc, during the servo operation. The servo voltage is determined as that voltage which delivers a fixed current from the high voltage power supply to the transfer roll shaft. The servo voltage varies with the environment, based on transfer roller resistivities and other environmental factors, such as Paschen breakdown voltage, Vion, or PC drum voltage.

The resulting transfer servo voltage is used as the basis for setting the high voltage power supply transfer voltage for the subsequent printing operation. The transfer "image" voltage typically is based upon a monotonic, piece-wise linear relationship to the servo voltage. Each color PC drum/transfer roller has a relationship between servo and image voltage based upon roller, belt, PC capacitance, process speed and toner characteristics. Individual relationships and individual transfer high voltage power supplies, are provided for each color station in one mode of the present invention, to allow for differences in toner layer thickness and toner charge properties.

It will be understood that an electrophotographic (EP) printer that can be used in the present invention typically includes several major components, including an electrical power supply, which typically receives AC voltage and outputs one or more DC voltages. Such an EP printer may also contain some type of processing circuit, such as a microprocessor or microcontroller, which typically has at least one address bus, one data bus, and perhaps one control bus or set of control signal lines. Such an EP printer (e.g., a laser printer) would also contain memory elements, such as read only memory (ROM) and random access memory (RAM), which also would typically be in communication with an address bus and data bus, and typically connected through the buses to the microprocessor or microcontroller.

Most printers receive print jobs from an external source, and in an EP printer there typically would be an input buffer to receive print data, usually through at least one input (or communication) port. In modern printers, a typical input port could be a USB port or a network ETHERNET port, but also other types of ports can be used, such as parallel ports and serial ports. The input buffer can be part of the overall system RAM, or it can be a separate set of memory elements or data registers, if desired.

In many modern EP printers, additional memory devices are included, such as some type of bulk memory device, or Flash memory or NVRAM-type memory devices. In today's technology, the semiconductor non-volatile memory devices typically are constructed of electrically-erasable programmable read only memory (EEPROM) devices. A bulk memory device could comprise a hard disk drive, or perhaps an optical drive that has read/write capabilities.

When a print job arrives at the input buffer, it is passed to a raster image processor (RIP) stage. In many modern printers, the RIP stage is physically comprised of an application specific integrated circuit (ASIC). The print job is typically divided into individual pages, and any restoring that may need to be performed will occur at this RIP stage. Once the print job as been divided into individual bitmap that represent pages, the print data is then sent to a print engine controller. It will be understood that, in many modern EP printer, an entire page of bitmap is not necessarily available in its final rasterized form at the moment when the first scanline of bitmap data is sent to the print engine controller for that same page.

From a control function standpoint, the print data will first arrive at raster image processor, and then be sent to the print engine controller. In many printers (including conventional laser printers), there is a separate ASIC for controlling the print raster imaging process and a separate ASIC for controlling the print engine. In many newer printers, the ASICs have become powerful enough that all of the elements that make up the rasterizer (image processor) and the print engine controller can be placed into a single ASIC package. The processing circuit and memory circuit elements may, or may not, be resident on the ASIC. The exact hardware configuration of these circuit components is not of critical importance in the present invention.

The print engine controller will control a physical print engine, which will typically include a photosensitive image-forming device, such as a photoconductive drum or a photoconductive belt. On FIG. 1, a photoconductive element (e.g., one of the cylindrical drums 24) receives modulated laser light on a surface area that becomes an image-forming region, thus forming a latent image on this surface by virtue of the modulated laser light discharging certain areas of the photoconductive element. This latent image will attract an image-forming material such as toner, and the image-forming material is then transferred to some type of print media, or in a multi-station print engine, the image-forming material is instead transferred to an intermediate transfer member (or "ITM"). It should be noted that the ITM might be a belt that forms an endless loop (such as the ITM belt 28 in FIG. 1), or the ITM might be another cylindrical drum that receives the multi-color image-forming material (e.g., toner). The physical output from the print engine is a sheet or roll of the print media (e.g., paper), such as that generally designated by the reference material 36 in FIG. 1.

It should be noted that much of the control logic needed for controlling the functions of the printing process and the sheet media movements of a printer can be off-loaded to a physically separate processing circuit, or to a virtual processing device. For example, a host computer could send appropriate command signals directly to output switching devices (e.g., transistors or triacs) that reside on the printer main body; the host computer could also directly receive input signals from various sensors on the printed remain body, to facilitate the control logic that is resident on such a host computer. Thus the control logic (or a portion thereof) of a printing device need not always be part of the physical printer, but may be resident in another physical device, or perhaps be virtual. In the present invention, the microprocessor may not have to reside within the printer body, but instead could be replaced by a set of electrical or optical command signal-carrying and data signal-carrying pathways (e.g., a set of parallel electrical conditions or fiber optic channels).

Figure 2:
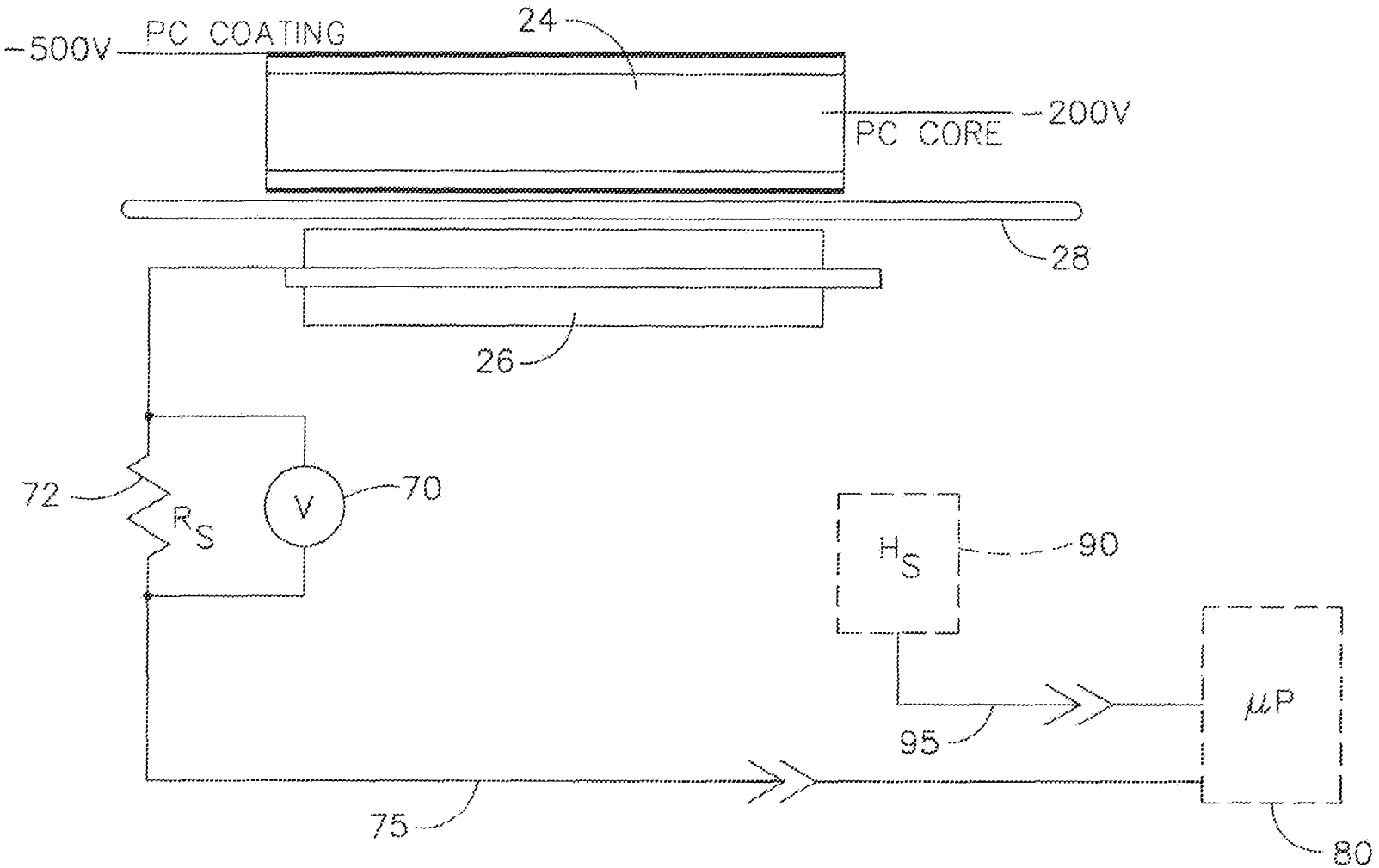
FIG. 2 is a diagrammatic view of certain components that create a transfer nip for an intermediate transfer belt of an EP printer, in which the voltage on the transfer roller is detected by a sense resistor, used in the printer of FIG. 1.

Referring now to FIG. 2, the transfer roll 26 has a voltage induced on its metal core, and as depicted in FIG. 2 the voltage of the photoconductive coating can be changed to one voltage while the photoconductive core portion of the roller can be set at a second voltage. In FIG. 2, the PC coating is set at −500 Volts DC, while the PC core is set at −200 Volts DC.

The transfer roller 26 for this PC drum 24 will typically be set to a voltage that is opposite in polarity to the charge on the toner, and this voltage can be controlled and varied by the print engine controller, if desired. The effective voltage on the transfer roller surface may be different than anticipated, compared to the applied voltage to that transfer rolled, depending on certain environmental conditions, and especially due to changes in humidity. In the present invention, the defective voltage on the transfer roller 26 is detected at a node generally designated by the reference numeral 70 on FIG. 2. A simple voltage sensing circuit is provided using a "sense resistor" 72, so that a very small amount of current will flow from the transfer roller 26 to that voltage-measuring node 70 through the sense resistor 72 (also referred to as R, on FIG. 2). By this circuitry, the print controller will have effective knowledge of the actual voltage conditions at the transfer roller 26. The voltage node 70 can be used to send a signal along a pathway 75 to a microprocessor or a microcontroller 80, which controls the entire printer. It should be noted that the processing circuit of the printer could be part of an ASIC (Application Specific Integrated Circuit).

As will be discussed below, the sensing circuit made up of the sense resistor 72 and the signal line 75 can be used to effectively determine the actual humidity conditions of the printer, in real time. As an alternative, an actual humidity sensor could instead by used, such as a humidity sensor generally designated by the reference numeral 90 of FIG. 2. This humidity sensor 90 could be located in fairly close proximity to a paper tray (not shown) or to the transfer nip between the PC drum 24 and the transfer roller 26, and if desired, it could be particularly located near the black color print engine 18 of the printing device of FIG. 1, or to the input paper tray. If used, the humidity sensor 90 would output an electrical signal along a pathway 95 to the controller or processing circuit 80.

As discussed above, environmental conditions can affect the efficiency of toner transfer to print media, and also to an intermediate transfer member (ITM), such as the continues ITM belt 28 of FIG. 1. If the final color print engine is the black toner print engine, then changes in environmental conditions will likely affect the black opacity more than that for the other process colors (e.g., cyan, magenta, and yellow).

In the present invention, the environmental conditions that probably are most important to transfer efficiency mainly involve the humidity, and by using the sense circuit of FIG. 2 the effective humidity can be determined in real time. An electrical current is run through the first and second transfer nip to measure the system resistively. The resistively of transfer rollers tends to especially vary, sometimes by more than a single order of magnitude, as humidity increases or decreases. The controller of the printer 80 can use the sense current to measure the resistively of a nip, and after measuring that resistively value, the controller can use an internal Look-up Table (LUT) to select an appropriate transfer voltage setting. This measurement step is often called a "servo," and in the present invention the frequency of measuring for the servo operation can be optimized to give the best print quality output with minimum disruption to printing time. For this invention, the term "frequency" means the number of pages printed between servo measurements.

The servo measurement value is available before printing beings for each print job. This value can then be used to command the printer to perform in a special way to assist the opacity of the black toner, since the black toner printing station will be the one most affected by an increase in the environmental humidity of the printer, assuming it is the "last" image-forming station along the travel of belt movement of the ITM belt 28.

In one mode of the present invention, the three process colors will be added to the rasterized bitmap at predetermined locations to improve the black opacity during high humidity conditions. In the selected (predetermined) locations in the bitmap, the system underlays the black printing with "process black" from the other three colors. In this way, print quality can be maintained for users who must use their equipment in environments that otherwise would produce washed-out, low density black. In this manner, the ability to use faster "black-only" speeds is maintained for the majority of environments and customers. The "pure" black pixel locations can represent a first set of dots in the print job's bitmap, while the "process" black pixel locations can represent a second set of dots in this bitmap. As will be discussed below, the second set of dots will usually be a subset of the first set of dots to produce "rich black" areas, although it is possible for the second set to be the same as the first set, for some print jobs. (In addition, the image data itself may also place process black dots at other pixel locations that have nothing to do with the first or second sets of data.)

As briefly discussed above, in high humidity environments, the transfer efficiency tends to drip due to decreasing transfer fields which causes decreasing toner charge. Merely increasing the mass developed in the toner cartridge is limited because the same hardware must not have too much mass for the other printing environments. The mass that will end up on the paper drops noticeably in high humidity and cannot easily be made up by normal bias values available in the printing cartridge. Therefore, in the present invention additional toner will be printed along with the pure black toner, so that for predetermined bitmap regions, there will be both supplemental toner (such as "process black") and "pure black" toner applied to the ITM and/or to the print media.

Adding a layer of toner below the black serves two purposes: first, it increases the mass available to be transferred, resulting in more toner on the final sheet of print media and a darker, smoother result. Unevenness in optical density is different, cartridge to cartridge, and so the patterns of evenness cancel each other out, thereby resulting in a more uniform as well as a darker final print. Second, the black is transferred on top of a base of other toner colors. This effectively provides a second transfer nip with low force, and the other toner layers (i.e., the process colors) serve as a "release layer" allowing the black toner to more easily transfer to the paper.

In one mode of the present invention, process black is recommended instead of using only a signal color as the underlaying or supplemental toner dot. By using process black, it prevents the "pure" black from having a yellow, cyan, or magenta tone (if only a single color was instead used). It is also less obvious in spew situations, or where misalignment is present.

However, if desired the supplemental toner could be process black, or "process gray" toner, for example, or it could be "pure gray" toner or perhaps it could be additional "pure black" toner (e.g., from a second black printing station). For the purposes of the present invention, the term "process gray" represents a neutral color, such as one that is along the L-axis of the L*a*b* color space. Alternatively, the supplemental toner could be a different non-neutral single color, such as yellow or cyan, as discussed below in greater detail.

With regard to process black dots, it will be understood that the actual toner dots do not necessarily need to literally stack upon each other at a single pixel location, for the present invention to correctly operate. Instead, the three process colors could be printed "near" each other (perhaps at adjacent pixel locations) so that the overall visual effect is that of the color black for a predetermined region of the bitmap. In other words, it is not always best to stack four (4) dots of color toner at multiple pixel locations, especially for a rather large area of an object to be printed; this would produce 400% toner coverage, which can be tolerated for small areas. If desired, but for most modern laser (EP) printers, usually it is not desirable to use 400% toner converge for "large" areas. If a "release layer" of process color toner dots is desired for a given "large" area or region of a bitmap, then the image processing software can arrange to always have at least on of the process colors printed at each of the corresponding pixel locations for which "rich black" is desired, according to the principles of the present invention.

Figure 3:
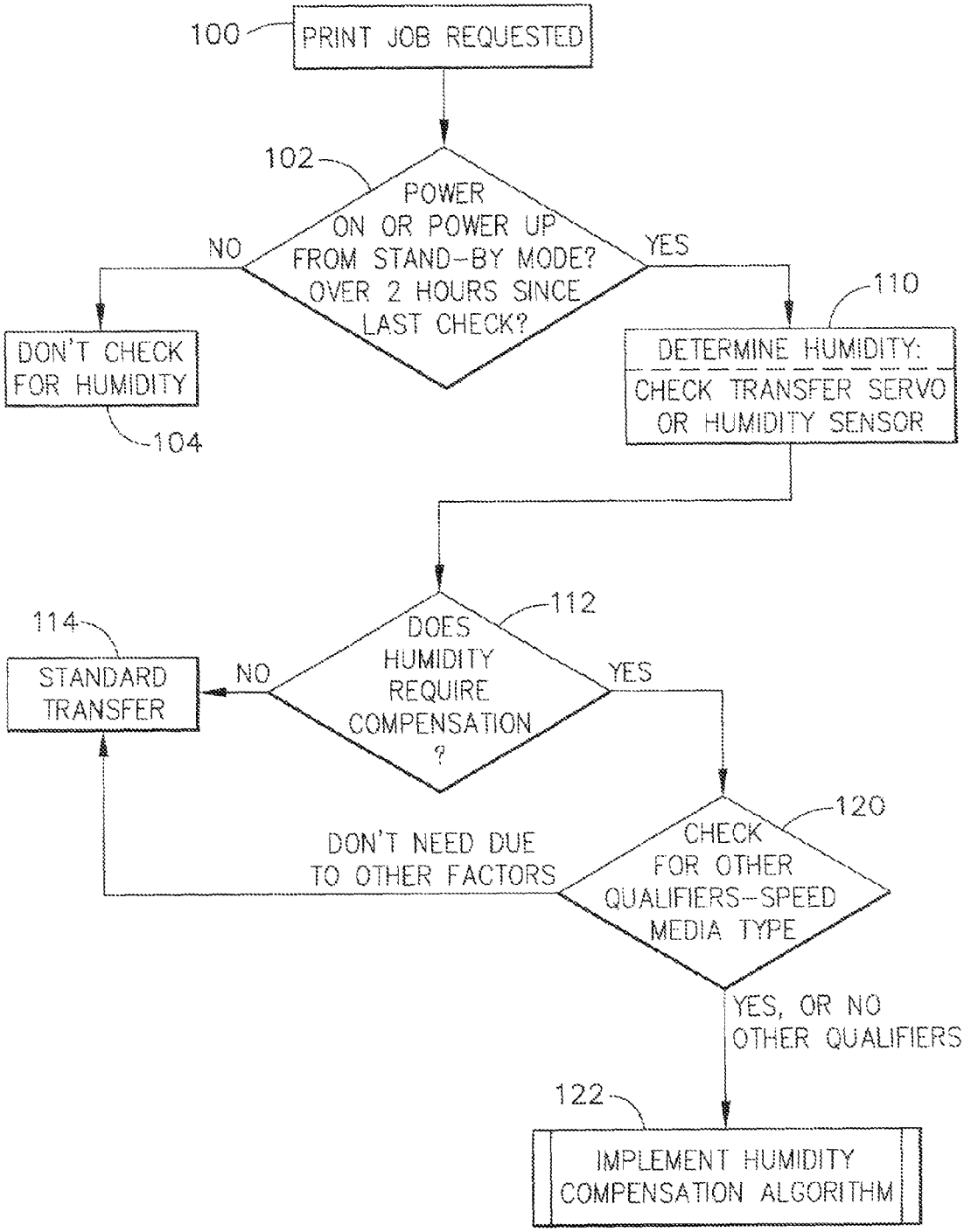
FIG. 3 is a flow chart of steps performed when using the present invention, to determine if the printer of FIG. 1 is operating in higher humidity conditions, and to determine if it requires compensation due to those conditions.
Figure 4:
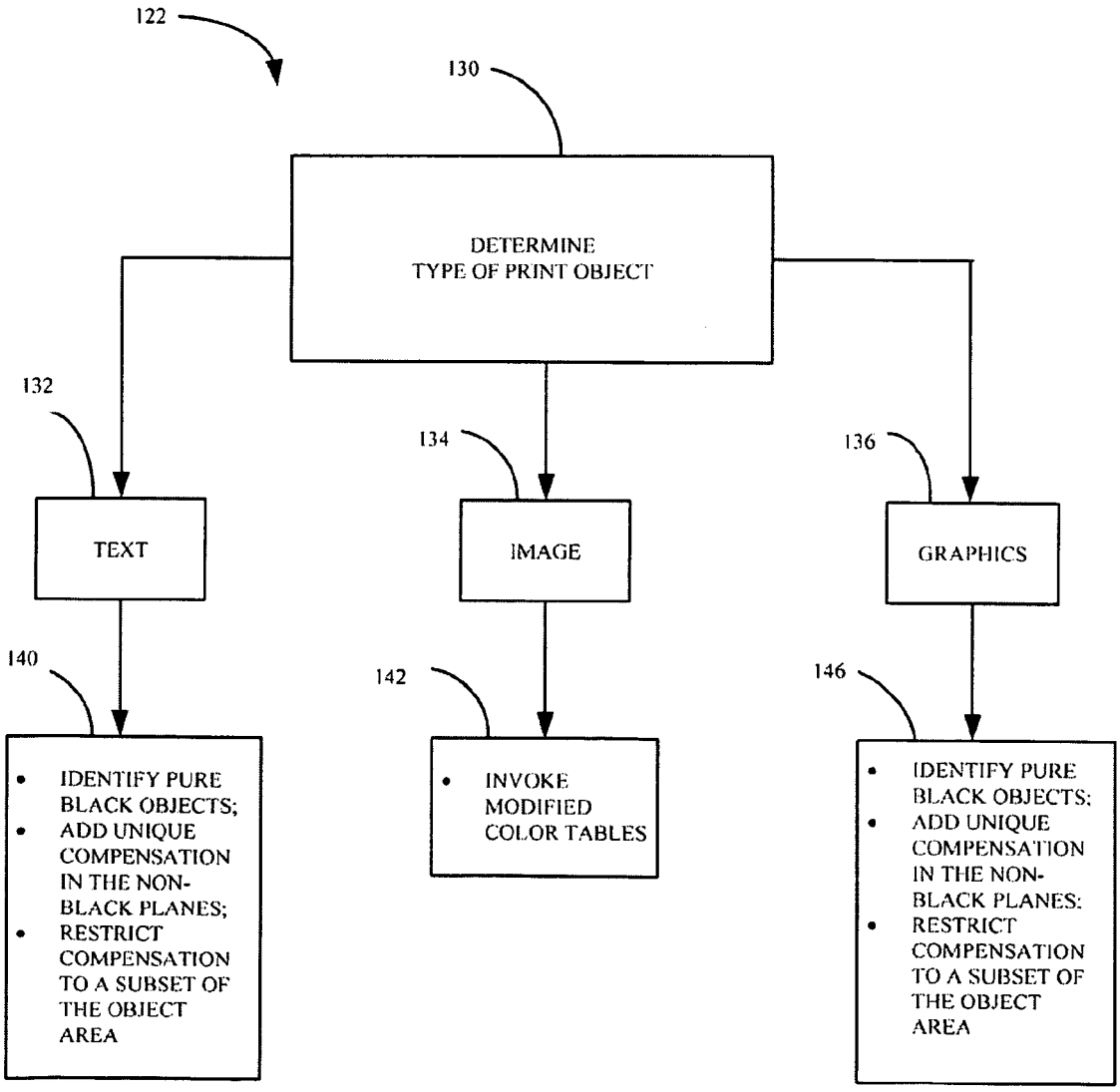
FIG. 4 is a flow chart of steps performed when using the principles of the present invention to improve the print quality of the black toner for the printer of FIG. 1, when high humidity conditions exist.

Some of the logical operations of the present invention are depicted in the flow charts of FIGS. 3 and 4. Referring now to FIG. 3, and initial step 100 occurs when a print job is requested. The printer the determines at a decision step 102 whether the printer is in a power on mode, or a power up mode from an existing stand-by mode. Additionally, this decision step checks to see if it has been more than two hours since the last similar check. If the answer is NO for all of these questions, then the logic flow is directed to a step 104 and the printer does not check for the present humidity conditions.

On the other hand, if the result is YES for any of the above questions in decision step 102, then the logic flow is directed to a step 110 where the current humidity is determined. As discussed above, the humidity can be determined directly by use of a humidity sensor, or indirectly by checking the effective voltage using the transfer servo function and the sense resistor circuit.

The logic flow is now direct to a decision step 112 that determines whether or not the humidity conditions are such that compensation is required. If the answer is NO, then the logic flow is directed to a step 114 which determines that a "standards" transfer voltage condition can be maintained, a printing will proceed in a normal (or standard) manner.

On the other hand, if the humidity conditions are such that compensation is required or recommended, then the logic flow is directed to a decision step 120 that checks for other qualifiers, such as printing speed and type of print media being used. If the result at decision step 120 is that compensation is not required due to other factors, then the logic flow is directed to the step 114, and standard transfer voltages and conditions will be maintained for this print job. On the other hand, if the humidity is such that compensation is required, or there are no other qualifiers, then the logic flow is directed to a step 122 that implements the algorithm of the present invention for compensating for the high humidity conditions.

An example of "other factors" could include printing speed, or the resistivity of the print media. Highly resistive print media would likely need less compensation, or would not need any compensation until reaching higher humidity condition (than for lower resistive print media). Examples of such highly resistive print media include transparencies, and also "outdoor media" that is plastic coated. If the print job is to be run at a relatively high printing speed, then again, less humidity compensation would probably be needed, or perhaps the level of compensation could be staged as the humidity condition increases further.

Referring now to FIG. 4, the humidity compensation algorithm 122 is depicted in flow chart form. Beginning at a decision step 130, the type of region (or object) to be printed is determined, since different types of regions/objects to be printed may have different requirements. If the object is a text-type object (such as word processing characters), then the logic flow is directed to a step 132. In that situation, a step 140 will identify pure black objects, add unique compensation in the non-black bitmap color planes, and restrict this compensation to a subset of the object area. The compensation could employ modified color tables or modified text rendering functions. To avoid excessive toner coverage, the compensation could involve halftoning. If the text object is small, the object area subset may not exist. This would restrict compensation to large text objects. This practice targets black objects but could be generalized to dark objects.

If the type of printing object is an image, then the output of decision step 130 is directed to a step 134, which directs the logic flow to a step 142 that will invoke modified color tables to improve transfer and darkness. These color tables could add unique compensation in the non-black bitmap color planes to pure black or dark regions.

If decision step 130 determines that the printing object is a graphics-type object, then a step 136 is the result. In the situation, a step 146 will identify pure black objects, add unique compensation in the non-black bitmap color planes, and restrict this compensation to a subset of the object area. This operation, and potential variations, is similar to step 132, but compensation would be optimized for graphics objects.

As an optional feature, if the object is a text-type object, then step 140 can optionally take into consideration the font size of certain text characters. For example, the humidity compensation algorithm may not be used unless the character to be printed is greater than for equal to) a predetermined font size. The threshold for what exact font size will be allowed to be compensated for, or not, could be user-selectable, if desired.

As another optional feature, if the object has discernable edges (or borders), such as text-type objects or certain types of image or graphics objects, then steps 140, 142, and 146 could take that into consideration when processing the bitmap for the non-black color planes, for example. In an situation where it generally would be desirable to use the compensation algorithm, special care can be given to the areas (or regions) in the bitmap near the image edges. If process black dots or regions are to be printed as the supplemental toner, then this optional feature could prevent such process black color toner from being added to the color planes near edges of an object in the bitmap, which will allow a certain amount of misregistration between the process black color printing stations without "spilling over" past the discernable edge created by the pure black printing station.

The above methodologies involve adding supplemental toner to predetermined objects in print jobs. In general, it is desirable to insure that the supplemental toner be actually printed within a reduced region (or subset) of the correct object in the bitmap. This concept is sometimes referred to as "trapping" or "choking" the region, and a more detailed description of this type of process is provided in U.S. Pat. No. 7,116,821, by one of the named co-inventors of the instant invention, and co-assigned to Lexmark International, Inc., and which is incorporated by reference herein in its entirety.

Although the present invention is mainly aimed at "helping" black toner to be placed on an intermediate transfer member, and then onto the print media, it is possible for the noticeably degrading. For example, yellow toner is much lighter, and thus less noticeable, than either cyan or magenta to the human visual system. Therefore, a three-color EP printer could be provided in which the yellow toner print engine is used to provide additional underlaying (or supplemental) dots of toner beneath certain bitmap pixels where cyan and/or magenta toner dots are to be laid, and either the cyan or magenta print station is the "last" such color printing station along the travel of the ITM belt. In this manner, the additional yellow toner dots will "asist" the final printed color dots (of either cyan or magenta) to be placed onto the ITM belt, and later onto the print media. Of course, this use of the principles of the present invention would probably end to be restricted to only certain types of print jobs, essentially at pixel locations where an extra yellow hue would not be visually distracting. Naturally, a fourth (black) printing station could also be used in such a printer, where the yellow dots underlay either the cyan or magenta toner, or the yellow dots could underlay the black toner if the black printing station is the last color station along the ITM's travel. Furthermore, cyan could perhaps be used instead of yellow as the supplemental toner material, since a constant hue (across most of a page, for example) may not be noticeable to a human viewer of the printout.

Moreover, it would be possible to provide a multi-color EP printer that uses a neutral color, such as gray, white, or "off-white" toner at one of the printing stations along the ITM. In such a color printer, the gray, white, or off-white toner could be the supplemental image-forming material that assists the printing of one of the other process or black color toner image-forming materials (i.e., whichever color toner printing station is the "last" station along the ITM's travel). This type of EP printer could have four (e.g., WhiteCMY or GrayCMY) or even five (e.g., CMYWhiteK or CMYGrayK) print stations of different colors. Furthermore, the supplemental image-forming material could be another printing station of "pure black" toner, if desired. That type of EP printer could have five (e.g., CMYKK or KCMYL) print stations of different colors. Finally, a "standard" four color printer could use "composite gray" instead of composite black, if desired, in which the CMY color printing stations along the ITM produce a "composite gray" set of color dots or regions, instead of composite black dots or regions.

It will be understood that the term "print media" herein refers to a sheet or roll of material that has toner or some other "printable" material applied thereto by a print engine, such as that found in a laser printer, or other type of electrophotographic printer. Alternatively, the print media represents a sheet or roll of material that has ink or some other "printable" material applied thereto by a print engine or printhead, such as that found in an ink jet printer, or which is applied by another type of printing apparatus that projects a solid or liquefied substance of one or more colors from nozzles or the like onto the sheet or roll of material. Print media is sometimes referred to as "print medium," and both terms have the same meaning with regard to the present invention, although the term print media is typically used in this patent document. Print media can represent a sheet or roll of plain paper, bond paper, transparent film (often used to make overhead slides, for example), or any other type of printable sheet or roll material.

It will also be understood that the logical operations described in relation to the flow charts of FIGS. 3-4 can be implemented using sequential logic, such as by using microprocessor technology, or using a logic state machine, or perhaps by discrete logic; it even could be implemented using parallel processors. One preferred embodiment may use a microprocessor or microcontroller to execute software instructions that are stored in memory cells within an ASIC. In fact, the entire microprocessor (or microcontroller), along with RAM and executable ROM, may be contained within a single ASIC, in one mode of the present invention. Of course, other types of circuitry could be used to implement the logical operations depicted in the drawings without departing from the principles of the present invention.

It will be further understood that the precise logical operations depicted in the flow charts of FIGS. 3-4, and discussed above, could be somewhat modified to perform similar, although not exact, function without departing from the principles of the present invention. The exact nature of some of the decision steps and other commands in these flow charts are directed toward specific future models of printers (those made and sold by Lexmark International, Inc., for example) and certainly similar, but somewhat different, steps would be taken for use with other models or brands of printers in many instances, with the overall inventive results being the same.

All documents cited in the Background of the Invention and in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular users contemplated. It is intended to cover in the appended claims all such changes and modifications that are within the scope of this invention.

The invention claimed is:

1. An image forming apparatus, comprising:

a humidity sensing device;

a print engine that includes a movable intermediate transfer member and a plurality of image-forming stations that apply image-forming material to said intermediate transfer member during a print job that generates a bitmap which comprises a plurality of pixel locations;

a print media handling device that moves print media to a transfer nip, where said image-forming material is transferred from said intermediate transfer member to said print media;

wherein:

(a) one of the image-forming stations applies black image-forming material;

(b) at least three of the other image-forming stations apply other colors that are equivalent to a process black;

(c) the black image-forming station is the last of said plurality of image-forming stations to apply image-forming material to said intermediate transfer member as it travels past said image-forming stations; and (d) if said humidity sensing device determines that a high humidity conditions exists such that compensation is desired, then:

(i) a first set of said pixel locations is determined where black image-forming material is placed upon said intermediate transfer member by said black image-forming station; and (ii) a second set of said pixel locations is determined that is at least a subset of the first set of said pixel locations, and, at the second set of said pixel locations, process black image-forming material is placed upon said intermediate transfer member by said at least three of the other image-forming stations.

2. The image forming apparatus as recited in claim 1, further comprising a processing circuit that communicates signals to and from said print engine; and a memory circuit that stores data used by said processing circuit; and wherein said processing circuit is physically located at one of: (a) said image forming apparatus, and (b) a separate computing apparatus.

3. The image forming apparatus as recited in claim 2, wherein said humidity sensing device comprises one of:

(a) a humidity sensor that outputs a signal to said processing circuit; and (b) a voltage sensing circuit that determines a resistivity at a transfer roller that is part of one of said plurality of image-forming stations, using a sense resistor.

4. The image forming apparatus as recited in claim 1, wherein the second set of said pixel locations depends upon a type of printing object, including: (a) a text object; (b) an image object; and (c) a graphics object.

5. The image forming apparatus as recited in claim 1, wherein said other colors that are equivalent to a process black comprise cyan, magenta, and yellow.

6. The image forming apparatus as recited in claim 1, wherein said movable intermediate transfer member comprises one of:

(a) a belt formed in an endless loop; and (b) a rotating drum.

7. The image forming apparatus as recited in claim 1, wherein said image-forming material comprises toner, and said print engine operates on an electrophographic principle.

8. The image forming apparatus as recited in claim 1, wherein while processing said print job, the second set of said pixel locations avoid areas of said bitmap near an edge of an object in an image.

9. The image forming apparatus as recited in claim 1, wherein, while processing said print job, the second set of said pixel locations are determined using a predetermined color table stored in said memory circuit, to fade into areas where process black dots are desired.

10. The image forming apparatus as recited in claim 1, wherein, while processing said print job, the second set of said pixel locations are used in a text object only for font characters greater than a predetermined size.

11. A method for compensating for environmental conditions, using an image forming apparatus, said method comprising:

(a) providing an image forming apparatus having: (i) a print engine that applies image-forming material to a movable intermediate transfer member at a plurality of image-forming stations, (ii) a print media handling device that moves print media to a transfer nip, where said image-forming material is transferred from said intermediate transfer member to said print media, and (iii) a humidity sensing device;

(b) processing a print job that generates a bitmap which comprises a plurality of pixel locations; and (c) determining whether a high humidity condition exists such that compensation is desired, and if so, then:

(i) determining a first set of said pixel locations, and thereat placing black image-forming material upon said intermediate transfer member using a black image-forming station of said plurality of image-forming stations; and (ii) determining a second set of said pixel locations that is at least a subset of the first set of said pixel locations, and, at the second set of said pixel locations, placing supplemental image-forming material upon said intermediate transfer member using at least three of the outer image-forming stations.

12. The method as recited in claim 11, wherein a processing circuit controls said moving and applying steps, and a memory circuit stores data used by said processing circuit; and wherein said processing circuit is physically located at one of: (a) said image forming apparatus, and (b) a separate computing apparatus.

13. The method as recited in claim 11, wherein the black image-forming station is the last of said plurality of image-forming stations to apply image-forming material to said intermediate transfer member as it travels past said image-forming stations.

14. The method as recited in claim 11, wherein said humidity sensing device comprises one of:

(a) a humidity sensor that outputs a signal to said processing circuit; and (b) a voltage sensing circuit that determines a resistivity at a transfer roller that is part of one of said plurality of image-forming stations, using a sense resistor.

15. The method as recited in claim 11, wherein the second set of said pixel locations depends upon a type of printing object, including: (a) a text object; (b) an image object; and (c) a graphics object.

16. The method as recited in claim 11, wherein said supplemental image-forming material comprises a process black color, comprising cyan, magenta, and yellow material.

17. The method as recited in claim 11, wherein said movable intermediate transfer member comprises one of: (a) a belt formed in an endless loop; and (b) a rotating drum.

18. The method as recited in claim 11, wherein said image-forming material comprises toner, and said print engine operates on an electrophographic principle.

19. The method as recited in claim 11, further comprising the step of avoiding areas of said bitmap near an edge of an object in an image, while determining the second set of said pixel locations.

20. The method as recited in claim 11, further comprising the step of using a predetermined color table stored in said memory circuit, to fade into areas where process black dots are desired, while determining the second set of said pixel locations.

21. The method as recited in claim 11, further comprising the step of using pixel locations for a text object that are only for font characters greater than a predetermined size, while determining the second set of said pixel locations.

22. An image forming apparatus comprising:

a humidity sensing device;

a print engine that includes a movable intermediate transfer member and a plurality of image-forming stations that apply image-forming material to said intermediate transfer member during a print job that generates a bitmap which comprises a plurality of pixel locations;

a print media handling device that moves print media to a transfer nip, where said image-forming material is transferred from said intermediate transfer to said print media;

wherein;

(a) a first of the image-forming stations applies first image-forming material of a first color, and a second of the image-forming stations applies second image-forming material of a second color;

(b) said first image-forming station applies a color that is at least as visually dark than the color that is applied by said second image-forming station;

(c) the first image-forming station is the last said plurality of image-forming station to apply image-forming material to said intermediate transfer member as it travels past said image-forming stations; and (d) if said humidity sensing device determines that a high humidity condition exists such that compensation is desired, then:

(i) a first set of said pixel locations is determined where first image-forming material is placed upon said intermediate transfer member by said first image-forming station; and (ii) a second set of said pixel locations is determined that is at least a subset of the first set of said pixel locations, and, at the second set of said pixel locations, second image-forming material is placed upon said intermediate transfer member by said second image-forming station.

23. The image forming apparatus as recited in claim 22, wherein a color of said second image-forming material comprises one of: (a) gray; (b) black; (c) white; and (d) "off-white."

24. The image forming apparatus as recited in claim 22, wherein a color of said second image-forming material comprises multiple individual colors that are an equivalent to one of: (a) process black; and (b) "process gray."

* * * * *